US012185824B2

(12) United States Patent
Wittig

(10) Patent No.: US 12,185,824 B2
(45) **Date of Patent: *Jan. 7, 2025**

(54) TRANSPARENT SCANNABLE BEVERAGE CONTAINER WITH MULTIPLE INTERCHANGEABLE MULTIFUNCTIONAL LIDS

(71) Applicant: Josefina Tatiana Wittig, Brownwood, TX (US)

(72) Inventor: Josefina Tatiana Wittig, Brownwood, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/471,911

(22) Filed: Sep. 21, 2023

(65) Prior Publication Data

US 2024/0008629 A1 Jan. 11, 2024

Related U.S. Application Data

(63) Continuation of application No. 17/651,616, filed on Feb. 18, 2022, now Pat. No. 11,805,887.
(Continued)

(51) Int. Cl.
*B65D 43/02* (2006.01)
*A45F 3/18* (2006.01)
(Continued)

(52) U.S. Cl.
CPC ..... *A45F 3/18* (2013.01); *A47G 19/2255* (2013.01); *B65D 25/28* (2013.01);
(Continued)

(58) Field of Classification Search
CPC ..... A47G 19/2255; A47G 19/2272; A47G 19/2266; A47G 19/2205; A47G 19/22; A47G 19/2288; A47G 19/2227; B65D 25/28; B65D 43/0225; B65D 43/0231; B65D 47/06; B65D 81/3837; B65D 81/3876; B65D 2231/022; B65D 2543/00046; B65D 2543/00537
(Continued)

(56) References Cited

U.S. PATENT DOCUMENTS 5,775,205 A * 7/1998 Melton ..... A47J 31/06 99/279
5,839,599 A * 11/1998 Lin ..... G09F 23/06 220/62.12

(Continued)

*Primary Examiner* — King M Chu
(74) *Attorney, Agent, or Firm* — Perkins Coie LLP; Michael Glenn; Vikram Iyengar

(57) ABSTRACT

A beverage container includes a transparent cylindrical acrylic body sized to fit into a cup-holder of a vehicle, a transparent skin sized to encase a portion of an outer surface of the body, a transparent handle, a transparent lid sized to seal a chamber defined by the body, a transparent latch, and a transparent rubber or plastic cover sized to be placed onto the lid. The container is scannable by an x-ray machine or a metal detector for inspecting the container and the a beverage in the chamber, and permits a visual inspection of the liquid through the container. The latch permits the beverage to exit the lid through an orifice for the beverage to be consumed when the latch is open configuration. The orifice is sized to permit a straw to be inserted through the orifice to consume the beverage.

20 Claims, 10 Drawing Sheets

Related U.S. Application Data

(60) Provisional application No. 63/207,250, filed on Feb. 19, 2021.

(51) Int. Cl.

| | |
|---|---|
| ***A47G 19/22*** | (2006.01) |
| ***B65D 25/28*** | (2006.01) |
| ***B65D 47/06*** | (2006.01) |
| ***B65D 81/38*** | (2006.01) |

(52) U.S. Cl.
CPC ..... *B65D 43/0225* (2013.01); *B65D 47/06* (2013.01); *B65D 81/3837* (2013.01); *B65D 81/3876* (2013.01); *B65D 2231/022* (2013.01)

(58) Field of Classification Search
USPC ..... 220/739, 592.2, 212, 903
See application file for complete search history.

(56) References Cited

U.S. PATENT DOCUMENTS

| | | | | |
|---|---|---|---|---|
| 5,909,821 | A * | 6/1999 | Guridi | B65D 81/3886 220/739 |
| 2002/0153381 | A1* | 10/2002 | Rohe | A47G 19/22 220/752 |
| 2010/0059522 | A1* | 3/2010 | Mayo | B65D 81/3869 206/459.5 |
| 2015/0291806 | A1* | 10/2015 | Turner | A47G 19/22 220/604 |
| 2018/0099783 | A1* | 4/2018 | Ng | B65D 25/54 |
| 2018/0170630 | A1* | 6/2018 | Ayriss | B65D 47/32 |
| 2019/0119030 | A1 | 4/2019 | Price et al. | |

* cited by examiner

TRANSPARENT SCANNABLE BEVERAGE CONTAINER WITH MULTIPLE INTERCHANGEABLE MULTIFUNCTIONAL LIDS

CROSS REFERENCE TO RELATED APPLICATIONS

This application is a continuation of U.S. patent application Ser. No. 17/651,616, filed Feb. 18, 2022, which claims the benefit of U.S. Provisional Patent Application No. 63/207,250, filed Feb. 19, 2021. The aforementioned applications are incorporated herein by reference in their entirety.

TECHNICAL FIELD

This description relates generally to travel mugs and specifically to a transparent scannable beverage container with multiple interchangeable multifunctional lids.

BACKGROUND

Traditional disposable coffee cups are made from paper and lined with polyethylene that cannot be removed by most recycling facilities, leading to plastic waste. On the other hand, traditional ceramic mugs can crack, break, or chip if not handled carefully, and larger ceramic coffee mugs may not keep a beverages hot for very long. Metal mugs cannot be used in a microwave to reheat a beverage, and can become warm on the outside, burning a user's hand. Moreover, a mug made of metal or other opaque material can present security issues when entering a correctional facility, courthouse, or airport security check.

SUMMARY

Apparatus and systems for transparent scannable beverage containers with multiple interchangeable multifunctional lids are disclosed. In some embodiments, a beverage container includes a cylindrical acrylic body sized to fit into a cup-holder of a vehicle. The body includes a transparent base and two transparent sidewalls extending from the base. The base and sidewalls define a chamber sized to contain 10-24 ounces of a beverage. The sidewalls are configured to thermally insulate the beverage. The chamber is open at a mouth of the body distal to the base. The body has a sidewall thread machined or molded onto a sidewall surface facing the chamber and proximal to the mouth, and a body thread machined or molded onto a body surface facing away from the chamber and proximal to the mouth.

A transparent rubber skin is shaped and sized to fit onto the body surface between the base and the mouth. The skin is configured to restrict the skin from slipping off the body, and reduce heat transfer from the chamber to a hand of a user gripping the skin for the container. A transparent acrylic handle having two ends is attached to the body surface proximal to the mouth at only one of the two ends. The handle is shaped to be gripped by a user for carrying the container, and the handle is sized to permit the body to fit into the cup-holder. A first transparent acrylic lid is shaped and sized to be placed in the mouth to seal the chamber. The first lid has a first lid thread, complementary to the sidewall thread, machined or molded onto a first lid surface. The first lid includes a transparent acrylic latch. The first lid is configured to be screwed into the sidewall surface using the first lid thread and the sidewall thread by twisting the latch when the latch is placed in an open configuration. The latch is configured to permit the beverage to exit the first lid through an orifice in the first lid when the latch is placed in the open configuration for the beverage to be consumed. The orifice is shaped and sized to permit a drinking straw to be inserted into the chamber through the orifice for the beverage to be consumed through the drinking straw. The latch is configured to seal the orifice when the latch is placed in a closed configuration to prevent the beverage exiting the first lid.

A second transparent acrylic lid is shaped and sized to be placed on the mouth to seal the chamber. The second lid has a second lid thread machined or molded onto a second lid surface and complementary to the body thread. The second lid is configured to be screwed into the body surface using the second lid thread and the body thread by twisting the second lid when the second lid is placed on the mouth. The second lid defines an opening shaped and sized to permit the drinking straw to be inserted into the chamber through the opening for the beverage to be consumed through the drinking straw. The second lid defines a spout shaped and sized to complement lips of the user for the beverage to be consumed through the spout.

A third transparent acrylic lid is shaped and sized to be placed on the mouth to seal the chamber. The third lid has a third lid thread machined or molded onto a third lid surface and complementary to the body thread. The third lid is configured to be screwed into the body surface using the third lid thread and the body thread by twisting the third lid when the third lid is placed on the mouth. The third lid defines a hole shaped and sized to permit the drinking straw to be inserted into the chamber through the hole for the beverage to be consumed through the drinking straw. A transparent rubber or plastic cover is sized to be placed onto each of the first lid, the second lid, and the third lid. The cover is shaped to encase the latch and the orifice to prevent transmission of germs proximate to the latch and the orifice when the first lid is placed in the mouth, encase the spout and the opening to prevent the transmission of germs proximate to the spout and the opening when the second lid is placed on the mouth, and encase the hole to prevent transmission of germs proximate to the hole when the third lid is placed on the mouth. The container is configured to receive one of the first lid, the second lid, or the third lid, and be scannable by at least one of an x-ray machine or a metal detector for inspecting the container and the beverage. The container is configured to permit a visual inspection of the beverage through the container.

In some embodiments, the container is free of metal. In some embodiments, the body surface comprises an antimicrobial layer. In some embodiments, the skin comprises an antimicrobial layer. In some embodiments, the handle comprises an antimicrobial layer. In some embodiments, the first lid comprises an antimicrobial layer. In some embodiments, the second lid comprises an antimicrobial layer. In some embodiments, the third lid comprises an antimicrobial layer. In some embodiments, the cover comprises an antimicrobial layer.

These and other aspects, features, and implementations can be expressed as apparatus, systems, components, and in other ways.

These and other aspects, features, and implementations will become apparent from the following descriptions, including the claims.

DETAILED DESCRIPTION

Figure 1:
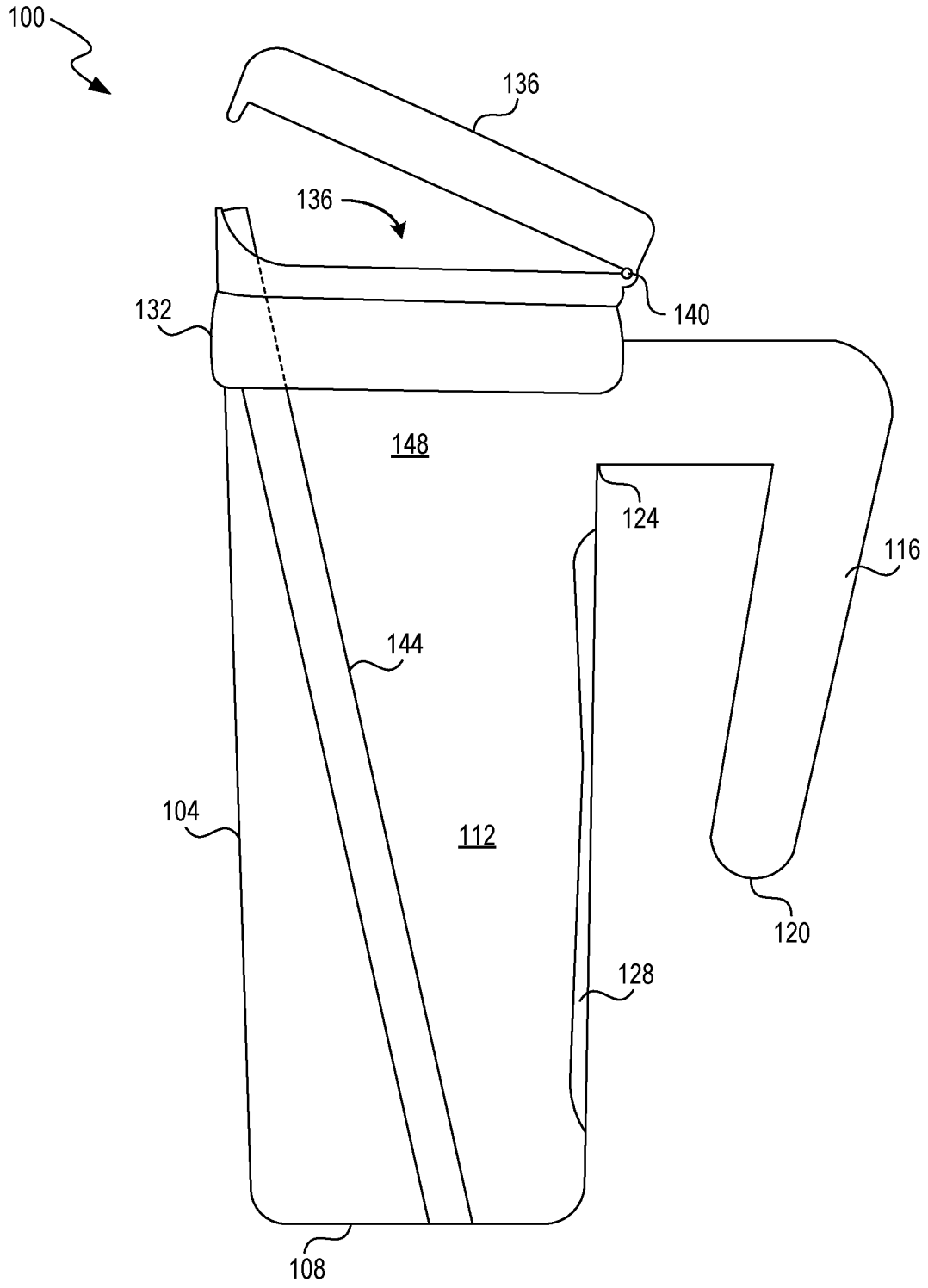
FIG. 1 is a drawing illustrating a transparent scannable beverage container with multiple interchangeable multifunctional lids, in accordance with one or more embodiments.

In the following description, for the purposes of explanation, numerous specific details are set forth in order to provide a thorough understanding of the present embodiments. It will be apparent, however, that the present embodiments may be practiced without these specific details.

This document presents systems and apparatus for a transparent scannable beverage container with multiple interchangeable multifunctional lids. In some embodiments, a beverage container includes a cylindrical acrylic body sized to fit into a cup-holder of a vehicle. The body includes a transparent base and two transparent sidewalls extending from the base. The base and sidewalls define a chamber sized to contain 10-24 ounces of a beverage. The sidewalls are configured to thermally insulate the beverage. The chamber is open at a mouth of the body distal to the base. The body has a sidewall thread machined or molded onto a sidewall surface facing the chamber and proximal to the mouth, and a body thread machined or molded onto a body surface facing away from the chamber and proximal to the mouth.

In some embodiments, a transparent rubber skin is shaped and sized to fit onto the body surface between the base and the mouth. The skin is configured to restrict the skin from slipping off the body, and reduce heat transfer from the chamber to a hand of a user gripping the skin for the container. In some embodiments, a transparent acrylic handle having two ends is attached to the body surface proximal to the mouth at only one of the two ends. The handle is shaped to be gripped by a user for carrying the container, and the handle is sized to permit the body to fit into the cup-holder. A first transparent acrylic lid is shaped and sized to be placed in the mouth to seal the chamber. The first lid has a first lid thread, complementary to the sidewall thread, machined or molded onto a first lid surface. The first lid includes a transparent acrylic latch. The first lid is configured to be screwed into the sidewall surface using the first lid thread and the sidewall thread by twisting the latch when the latch is placed in an open configuration. The latch is configured to permit the beverage to exit the first lid through an orifice in the first lid when the latch is placed in the open configuration for the beverage to be consumed. The orifice is shaped and sized to permit a drinking straw to be inserted into the chamber through the orifice for the beverage to be consumed through the drinking straw. The latch is configured to seal the orifice when the latch is placed in a closed configuration to prevent the beverage exiting the first lid.

In some embodiments, a second transparent acrylic lid is shaped and sized to be placed on the mouth to seal the chamber. The second lid has a second lid thread machined or molded onto a second lid surface and complementary to the body thread. The second lid is configured to be screwed into the body surface using the second lid thread and the body thread by twisting the second lid when the second lid is placed on the mouth. The second lid defines an opening shaped and sized to permit the drinking straw to be inserted into the chamber through the opening for the beverage to be consumed through the drinking straw. The second lid defines a spout shaped and sized to complement lips of the user for the beverage to be consumed through the spout.

In some embodiments, a third transparent acrylic lid is shaped and sized to be placed on the mouth to seal the chamber. The third lid has a third lid thread machined or molded onto a third lid surface and complementary to the body thread. The third lid is configured to be screwed into the body surface using the third lid thread and the body thread by twisting the third lid when the third lid is placed on the mouth. The third lid defines a hole shaped and sized to permit the drinking straw to be inserted into the chamber through the hole for the beverage to be consumed through the drinking straw. A transparent rubber or plastic cover is sized to be placed onto each of the first lid, the second lid, and the third lid. The cover is shaped to encase the latch and the orifice to prevent transmission of germs proximate to the latch and the orifice when the first lid is placed in the mouth, encase the spout and the opening to prevent the transmission of germs proximate to the spout and the opening when the second lid is placed on the mouth, and encase the hole to prevent transmission of germs proximate to the hole when the third lid is placed on the mouth. The container is configured to receive one of the first lid, the second lid, or the third lid, and be scannable by at least one of an x-ray machine or a metal detector for inspecting the container and the beverage. The container is configured to permit a visual inspection of the beverage through the container.

The advantages and benefits of the transparent scannable beverage container with multiple interchangeable multifunctional lids described herein include the ability to readily pass through security checkpoints, such as correctional facilities, detention facilities, airport security checkpoints, and other places where going through an x-ray scanning machine or metal detector is necessary. Many correctional facilities mandate there should be no metal in containers or that containers should be transparent. The double sidewalls of the container provide thermal isolation to the beverage within, such that the beverage can be consumed hot or cold at a later time. The multiple interchangeable multifunction plastic lids can be used one at a time to consume the beverage in different ways, e.g., using a spout like a sippy cup or through a straw. Moreover, some embodiments have a spill prevention slide latch. The hook shaped handle provides easy grab-N-go functionality while enabling the container to readily fit in a car's cupholder. The lids are transparent and shatter-resistant.

In addition, the container is corrosion resistant and, in some embodiments, repels stains. The tight fitted flip-open lid having a safety latch makes drinking from the container easy and prevents beverages from spilling. The design is lightweight and compact for portability, leak proof, and include a wide mouth to accommodate full size ice cubes, and is easy to fill with beverage. An air vent on the lid allows beverages to flow out smoothly, without gushing or overflowing. All surfaces that come into contact with beverages are BPA free. Importantly, the container, including handle and lids is fully transparent to permit a visual inspection of the beverage through the container at a security checkpoint when entering a correctional facility.

FIG. 1 is a drawing illustrating a transparent scannable beverage container 100 with multiple interchangeable multifunctional lids, in accordance with one or more embodiments. Likewise, other embodiments include different and/or additional components, or are connected in a different manner. The container 100 includes a cylindrical body 104 sized to fit into a cup-holder of a vehicle, such as a car of van. The body is transparent and, in some embodiments, is made of acrylic, a transparent plastic, transparent rubber, etc. For example, the components of the container 100 can be made of Polyethylene Terephthalate (PET), Amorphous Copolyester (PETG), Polyvinyl Chloride (PVC), Liquid Silicone Rubber (LSR), etc. The container 100 is therefore easier to manufacture, lightweight, durable, shatter-resistant, and has lower production costs compared to traditional containers. The material of the container 100 achieves visible light transmission and/or optical refractive power comparable to glass and is thus visually scannable at a security check to determine the contents inside the container 100.

The body 104 includes a transparent base 108 and (in some embodiments) two transparent sidewalls extending from the base 108. Example sidewalls 204, 208 are illustrated and described in more detail with reference to FIG. 2. The base 108 and transparent sidewalls define a chamber 112 sized to contain (in some embodiments) 10-24 ounces of a beverage, such as coffee, tea, water, juice, etc. The chamber 112 is open at a mouth 136 of the body 104 distal to the base 108. In some embodiments, the body has a body thread on a body surface 148 facing away from the chamber 112 and proximal to the mouth 136 for a multifunctional interchangeable lid 132 to be screwed onto the body. In other embodiments, the lid 132 is simply pushed tightly onto the mouth 136 to fasten it to the body. The lid 132 is interchangeable with other multifunctional lids, e.g., lids 300, 330, 380 illustrated and described in more detail with reference to FIGS. 3A, 3B, and 3C.

In some embodiments, the body 104 includes a transparent handle 116 having two ends 120, 124. The handle is made of a transparent plastic, acrylic, etc. The handle 116 is attached to the body surface 148 proximal to the mouth 136 at only one end 124 of the two ends 120, 124. The handle 116 is shaped to be gripped by a user for carrying or holding the container 100. The handle 116 is sized to permit the body 104 to fit into a cup-holder of a vehicle. A handle that is attached to the body 104 at both ends of the handle generally does not permit the body 104 to fit into a cup-holder.

In some embodiments, the lid 132 shaped and sized to be placed on the mouth 136 to seal the chamber 112. In some embodiments, the lid 132 permits the beverage to exit the lid 132 through an orifice in the lid 132. The terms orifice, hole, and opening are used interchangeably in the descriptions of the embodiments herein. The hole, orifice, or opening in the lid 132 can be shaped and sized to permit a drinking straw 144 to be inserted into the chamber 112 through the orifice for the beverage to be consumed through the drinking straw 144. In other embodiments, the lid 132 is shaped similar to a circular ring surrounding the mouth 136 and the mouth 136 is open even when the lid 132 is placed around the mouth 136 such that a user can drink the beverage by tipping the container 100 and holding their lips to an edge of the lid 132. In other embodiments, a user can put the straw 144 into the container through the lid 132 for drinking through the straw. In some embodiments, the lid 132 has a lid thread on a lid surface complementary to the body thread for screwing the lid 132 onto the body 104. The term "complementary" here means the lid thread and the body thread match each other's diameter and thread pitch such that they interlock when the lid 132 is screwed onto the body 104. For example, the lid 132 can be screwed into the body surface 148 using the lid thread and the body thread by twisting the lid 132 when the lid 132 is placed on the mouth 136.

In some embodiments, a transparent rubber or plastic cover 136 is sized to be placed onto the lid 132 and other lids, e.g., lids 300, 330, 380. The cover can have a hinge 140 to fasten onto another portion of the cover 136 or the lid 132. The cover 136 is shaped to encase the orifice to prevent transmission of germs proximate to the orifice when the lid 132 is placed on the mouth 136. Thus, the cover 136 prevents the spreads of germs, virus, COVID-19, bacteria, etc., in a hospital or other healthcare environment, nursing home, prison, school, etc. The container 100 is configured to be scannable by at least one of an x-ray machine or a metal detector for inspecting the container 100 and the beverage within, e.g., at an airport security checkpoint, security entrance to a detention or correctional facility, sports event, school, etc. The container 100 has no metal or glass in it. The container 100 is designed to permit a visual inspection of the beverage through the container 100 for security.

In some embodiments, the body surface 148 includes an antimicrobial layer 128. The antimicrobial layer 128 contains an antimicrobial agent that inhibits the ability of microorganisms to grow on the surface of the container 100. The antimicrobial layer 128 is useful for use in various settings including clinics, industry, and even the home. The antimicrobial layer 128 can be functionalized in a variety of different processes. A coating can be applied to the body 104 that has a chemical compound which is toxic to microorganisms. In the alternative, it is possible to functionalize the body surface 148 by adsorbing a polymer or polypeptide and/or by changing its micro and nanostructure.

Figure 2:
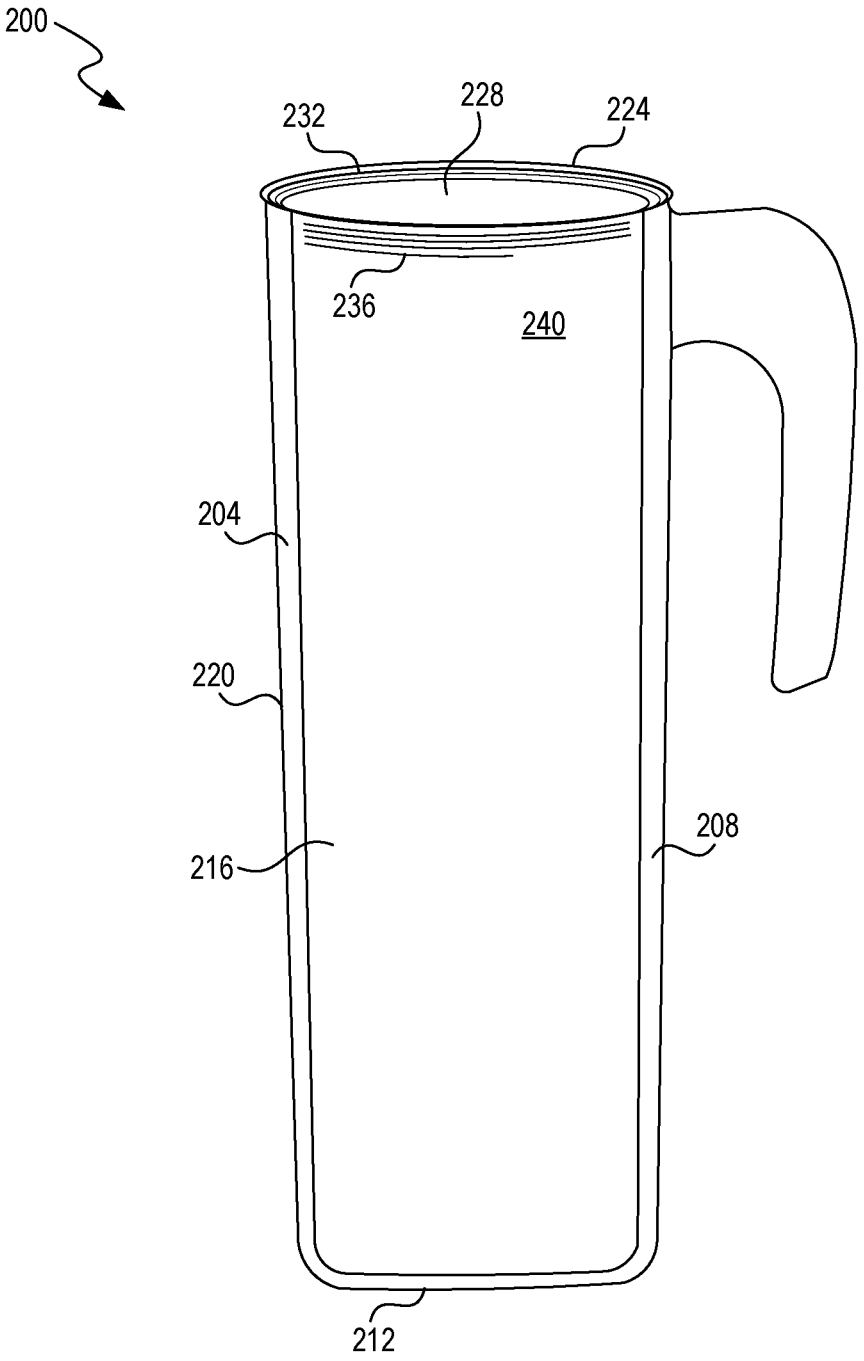
FIG. 2 is a drawing illustrating a transparent scannable beverage container with multiple interchangeable multifunctional lids, in accordance with one or more embodiments.

FIG. 2 is a drawing illustrating a transparent scannable beverage container 200 with multiple interchangeable multifunctional lids, in accordance with one or more embodiments. Likewise, other embodiments include different and/or additional components, or are connected in a different manner. The container 200 is made of a transparent non-metallic material similar to the container 100 illustrated and described in more detail with reference to FIG. 1. The container 200 includes a cylindrical body 220 sized to fit into a cup-holder of a vehicle. The body 220 includes a transparent base 212 and, in some embodiments, two transparent sidewalls 204, 208 extending from the base 212. The base 212 and transparent sidewalls 204, 209 define a chamber 216 sized to contain a beverage. The sidewalls 204, 208 are shaped and sized to thermally insulate the beverage for consumption by a user after a period of time has passed. The container 200 can thus keep the beverage hot or cold for a longer period of time.

The chamber 216 is open at a mouth 224 of the body 220 distal to the base 212. In some embodiments, the body 220 has a sidewall thread 232 on a sidewall surface 228 facing the chamber 216 and proximal to the mouth 224. The sidewall thread 232 is a helical structure used to convert between rotational and linear movement or force for tightening a lid (e.g., lid 132 of FIG. 1) onto the body 220. The sidewall thread 232 can be a ridge wrapped around the sidewall surface 228 in the form of a helix, e.g., a straight thread or a tapered thread. The body 220, in some embodiments, has a body thread 236 on a body surface 240 facing away from the chamber 216 and proximal to the mouth 224.

In some embodiments, the container 200 has a handle having two ends. The handle is attached to the body surface 240 proximal to the mouth 224 at only one of the two ends. The handle is shaped to be gripped by a user. The handle is sized to permit the body 220 to fit into a cup-holder. In some embodiments, a lid (e.g., lid 300 of FIG. 3A) is shaped and sized to be placed in the mouth 224 to seal the chamber 216. The lid has a lid thread, complementary to the sidewall thread 232. The lid is configured to be screwed into the sidewall surface 228 using the lid thread and the sidewall thread 232. In some embodiments, a lid (e.g., lid 380 of FIG. 3C) is shaped and sized to be placed on the mouth 224 to seal the chamber 216. The lid has a lid thread complementary to the body thread 236. The lid is configured to be screwed into the body surface 240 using the lid thread and the body thread 236 by twisting the lid when the lid is placed on the mouth.

Similar to the container 100 of FIG. 1, the container 200 is configured to be scannable by at least one of an x-ray machine or a metal detector for inspecting the container 200 and the beverage. The container 200 is configured to permit a visual inspection of the beverage through the container 200. The container 200 is free of metal and glass.

Figure 3A:
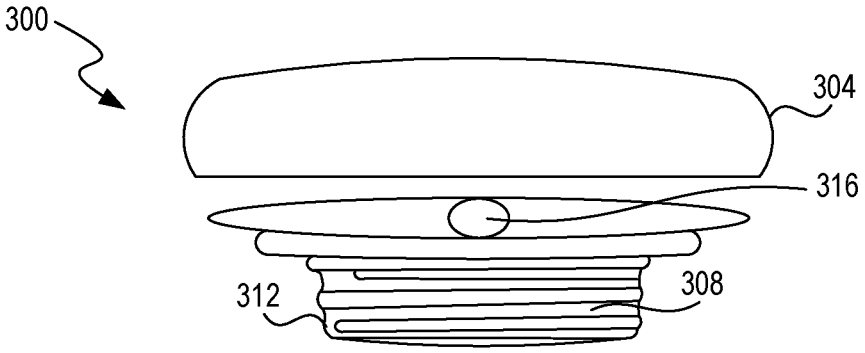
FIGS. 3A, 3B, and 3C are drawings illustrating transparent scannable multifunctional lids, in accordance with one or more embodiments.
Figure 3B:
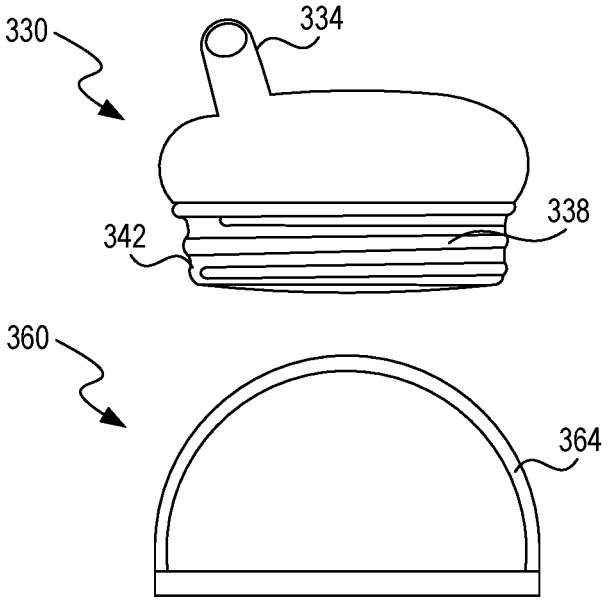
Figure 3C:
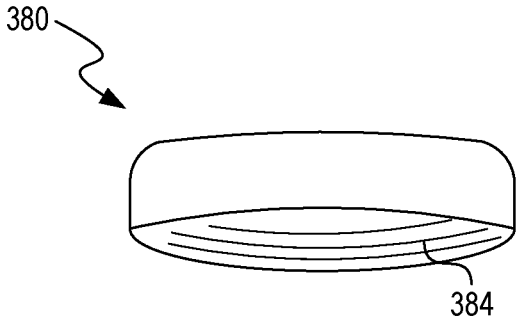

FIGS. 3A, 3B, and 3C are drawings illustrating transparent scannable multifunctional lids, in accordance with one or more embodiments. Likewise, other embodiments include different and/or additional components, or are connected in a different manner. FIG. 3A illustrates a transparent lid 300 shaped and sized to be placed in a mouth (e.g., mouth 224 of FIG. 2) of a container (e.g., container 200 of FIG. 2) to seal a chamber (e.g., chamber 216 of FIG. 2) of the container. The lid 300 is transparent and made of any of the materials described with reference to container 100 in FIG. 1. The lid 300 has a lid thread 308 that is complementary to a sidewall thread (e.g., sidewall thread 232 in FIG. 2) on a lid surface 312 of the lid 300. The lid 300 is configured to be screwed into a sidewall surface (e.g., sidewall surface 228 of FIG. 2) of a container (e.g., container 200 of FIG. 2) using the lid thread 308 and the sidewall thread by twisting the lid 300 when the lid is placed on a body (e.g., body 220) of the container.

The lid 300 permits a beverage to exit the lid 300 through an orifice 316 in the lid 300 when a container on which the lid is affixed is tilted for the beverage to be consumed. In some embodiments, the hole or orifice 316 is shaped and sized to permit a drinking straw (e.g., straw 144 of FIG. 1) to be inserted into the container through the orifice 316 for the beverage to be consumed through the drinking straw. In some embodiments, a transparent rubber or plastic cover 304 is sized to be placed onto the lid 300. The cover 304 is shaped to encase at least the orifice 316 to prevent transmission of germs proximate to the orifice 316 when the lid 300 is placed in the mouth of the container. The lid 300 is configured to be scannable by at least one of an x-ray machine or a metal detector for inspecting the lid 300, the container, and the beverage. The lid 300 permits a visual inspection of the beverage through the lid 300. The lid 300 is free of metal and glass.

FIG. 3B illustrates a transparent lid 330 shaped and sized to be placed in a mouth (e.g., mouth 224 of FIG. 2) of a container (e.g., container 200 of FIG. 2) to seal a chamber (e.g., chamber 216 of FIG. 2) of the container. The lid 330 is transparent and made of any of the materials described with reference to container 100 in FIG. 1. The lid 330 has a lid thread 338 that is complementary to a sidewall thread (e.g., sidewall thread 232 in FIG. 2) on a lid surface 342 of the lid 330. The lid 330 is configured to be screwed into a sidewall surface (e.g., sidewall surface 228 of FIG. 2) of a container (e.g., container 200 of FIG. 2) using the lid thread 338 and the sidewall thread by twisting the lid 330 when the lid is placed on a body (e.g., body 220) of the container.

The lid 330 includes a spout 334 shaped and sized to complement lips of a user for a beverage to be consumed through the spout 334. In some embodiments, a transparent rubber or plastic cover 360 is sized to be placed onto the lid 330. The cover 360 is shaped to encase at least the spout 334 to prevent transmission of germs proximate to the spout 334 when the lid 330 is placed in the mouth of the container. The lid 330 is configured to be scannable by at least one of an x-ray machine or a metal detector for inspecting the lid 330, the container, and the beverage. The lid 330 permits a visual inspection of the beverage through the lid 330. The lid 330 is free of metal and glass. In some embodiments, the cover 360 includes an antimicrobial layer 364. The antimicrobial layer 364 is similar to the antimicrobial layer 128 of FIG. 1.

FIG. 3C illustrates a transparent lid 380 shaped and sized to be placed on a mouth (e.g., mouth 224 of FIG. 2) of a container (e.g., container 200 of FIG. 2) to seal a chamber (e.g., chamber 216 of FIG. 2) of the container. The lid 380 is transparent and made of any of the materials described with reference to container 100 in FIG. 1. The lid 380 has a lid thread 384 that is complementary to a body thread (e.g., body thread 236 in FIG. 2) on a body surface of the container. The lid 380 is configured to be screwed into the body surface (e.g., body surface 240 of FIG. 2) of a container (e.g., container 200 of FIG. 2) using the lid thread 384 and the body thread by twisting the lid 380 when the lid 380 is placed on a body (e.g., body 220) of the container.

The lid 380 is configured to be scannable by at least one of an x-ray machine or a metal detector for inspecting the lid 380, the container, and the beverage. The lid 380 permits a visual inspection of the beverage through the lid 380. The lid 380 is free of metal and glass. Any and all of the lids described herein can have an antimicrobial layer.

Figure 4:
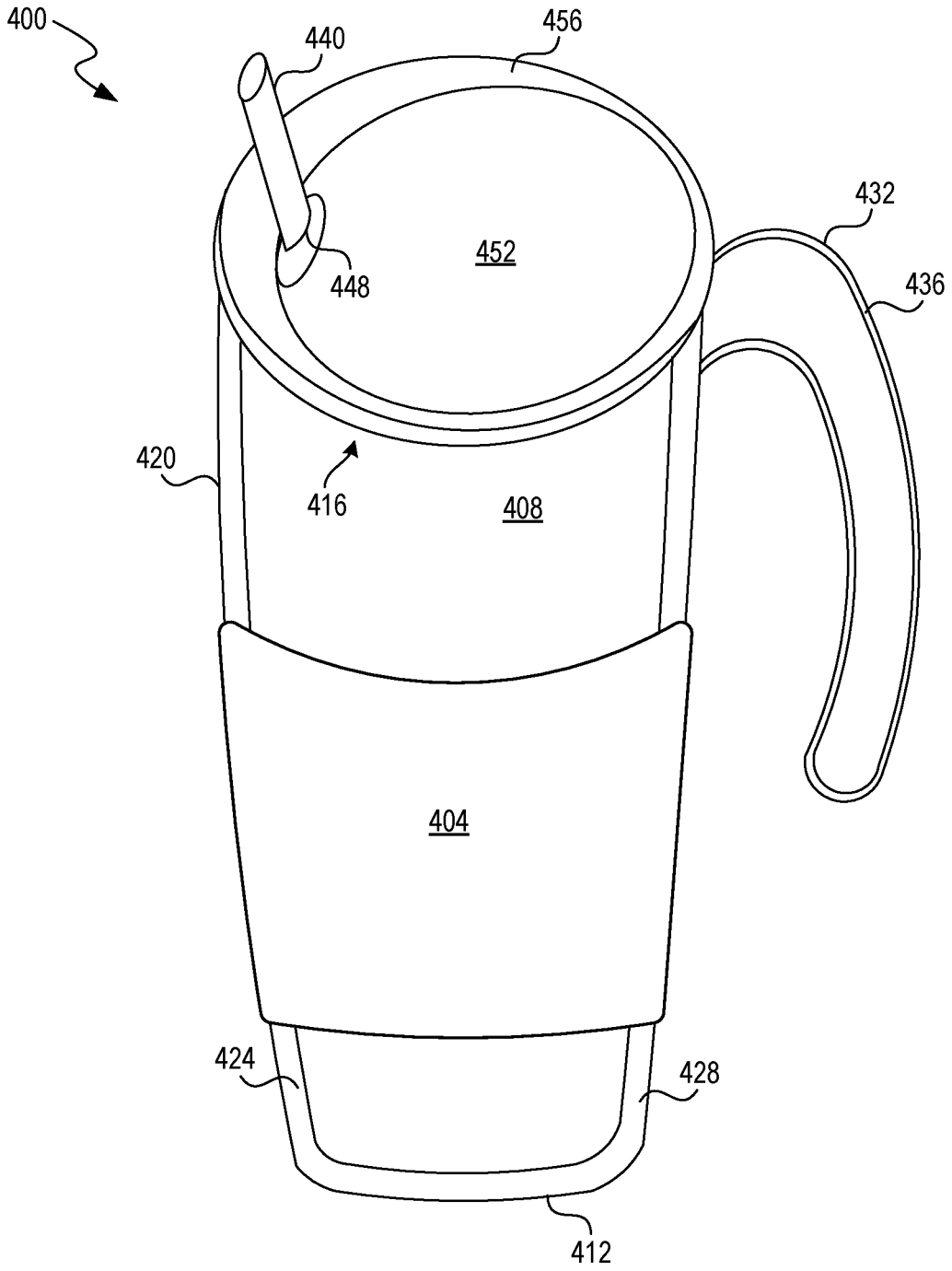
FIG. 4 is a drawing illustrating a transparent scannable beverage container with multiple interchangeable multifunctional lids, in accordance with one or more embodiments.

FIG. 4 is a drawing illustrating a transparent scannable beverage container 400 with multiple interchangeable multifunctional lids, in accordance with one or more embodiments. Likewise, other embodiments include different and/or additional components, or are connected in a different manner. The container 400 includes a cylindrical body 420 sized to fit into a cup-holder of a vehicle. The body 420 includes a transparent base 412 and two transparent sidewalls 424, 428 extending from the base 412. In some embodiments, the base 412 and transparent sidewalls 424, 428 define a chamber sized to contain 10-24 ounces of a beverage. The sidewalls 424, 428 are configured to thermally insulate the beverage. The chamber is open at a mouth 416 of the body 420 distal to the base 412.

In some embodiments, the container 400 includes a transparent rubber skin 404 shaped and sized to fit onto a body surface 408 between the base 412 and the mouth 416. The skin 404 is configured to restrict the skin 404 from slipping off the body 420 and reduce heat transfer from the chamber to a hand of a user gripping the skin 404. In some embodiments, the skin 404 comprises an antimicrobial layer. In some embodiments, the container 400 includes a transparent (e.g., acrylic) handle 432 having two ends. The handle 432 is attached to the body surface 408 proximal to the mouth 416 at only one of the two ends. The handle is shaped to be gripped by a user and sized to permit the body 420 to fit into a cup-holder. In some embodiments, the handle 432 includes an antimicrobial surface.

In some embodiments, the container 400 includes a transparent multifunctional lid 452 shaped and sized to be placed in the mouth 416 to seal the chamber. The lid 452 is interchangeable with other multifunctional lids, e.g., lids 300, 330, 380 illustrated and described in more detail with reference to FIGS. 3A, 3B, and 3C. In some embodiments, the lid 452 has a protruding rim 456. The lid 452 is configured to permit the beverage to exit the lid through an orifice 448 in the lid 452 for the beverage to be consumed. In some embodiments, the orifice 448 is shaped and sized to permit a drinking straw 440 to be inserted into the chamber through the orifice 448 for the beverage to be consumed through the drinking straw 440.

The container 400 is configured to be scannable by at least one of an x-ray machine or a metal detector for inspecting the container 400 and the beverage. The container 400 is configured to permit a visual inspection of the beverage through the container 400. The container 400 is free of metal and glass.

Figure 5:
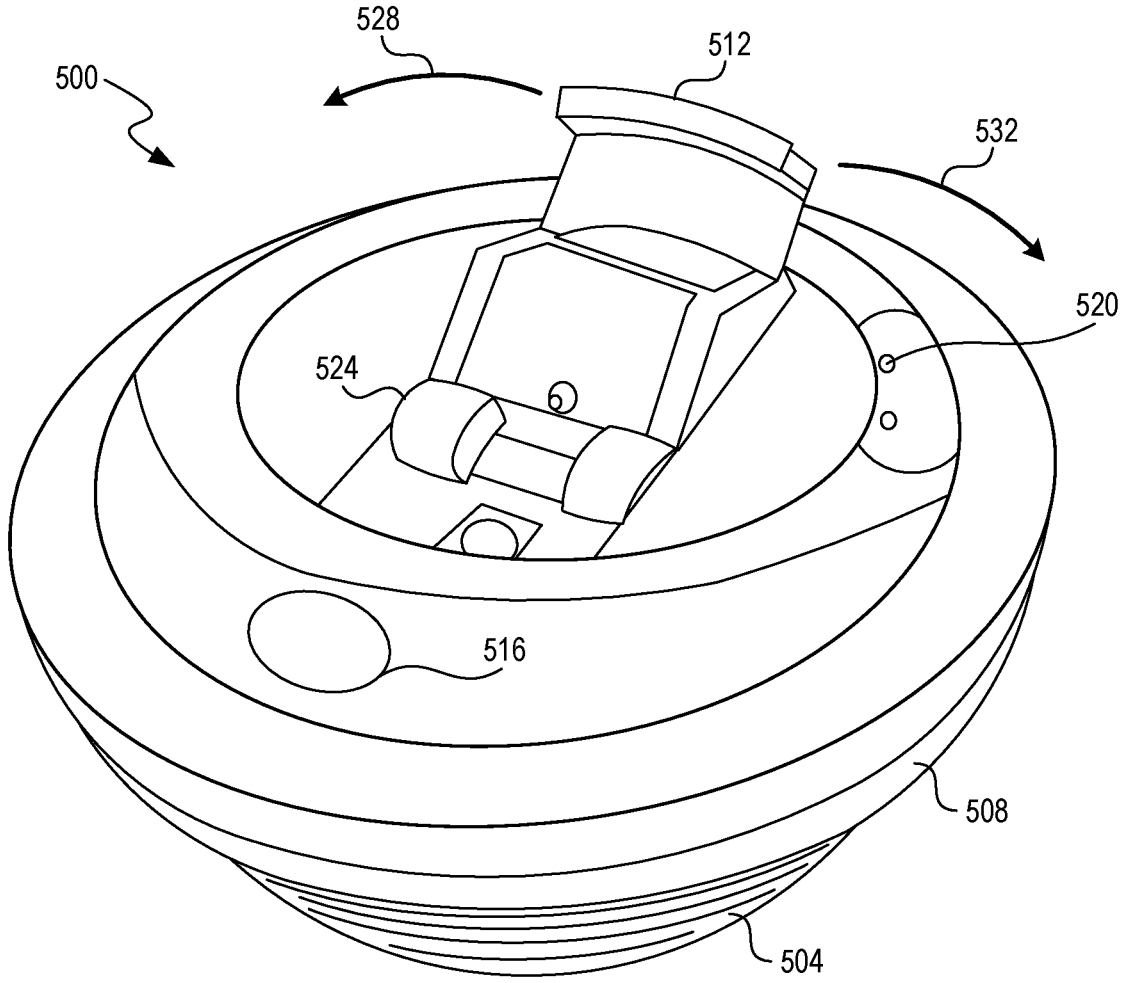
FIG. 5 is a drawing illustrating a transparent scannable multifunctional lid, in accordance with one or more embodiments.

FIG. 5 is a drawing illustrating a transparent scannable multifunctional lid 500, in accordance with one or more embodiments. Likewise, other embodiments include different and/or additional components, or are connected in a different manner. The lid 500 is shaped and sized to be placed in a mouth (e.g., mouth 224 of FIG. 2) of a container (e.g., container 200 of FIG. 2). The lid 500 has a lid thread 504 on a lid surface 508. The lid thread 504 is complementary to a sidewall thread (e.g., sidewall thread 232 of FIG. 2) of the container. The lid 500 includes a transparent latch 512 attached to a surface of the lid 500 by a hinge 524. The latch 512 can be pivoted on the hinge 524 to alternate between an open configuration (shown by FIG. 5) and a closed configuration.

The lid 500 is configured to be screwed into a sidewall surface (e.g., sidewall surface 228 of FIG. 2) using the lid thread 504 and the sidewall thread by moving the latch 512 circularly when the latch 512 is placed in an open configuration. For example, the latch is moved in the direction 532 to be screwed in to the sidewall surface and the latch is moved in the direction 528 for the lid to be removed from the container. The latch 512 is configured to permit the beverage to exit the lid 500 through an orifice 516 in the lid 500 when the latch 512 is placed in the open configuration (shown by FIG. 5) for the beverage to be consumed. In some embodiments, the orifice 516 is shaped and sized to permit a drinking straw (e.g., straw 440 of FIG. 4) to be inserted into the container through the orifice 516 for the beverage to be consumed through the drinking straw. The lid 500 has a hole 520 for air to enter the container as the beverage is consumed to assist the flow of the beverage out of the orifice 516. The latch 512 is configured to seal the orifice 516 when the latch 512 is placed in a closed configuration to prevent the beverage exiting the lid 500.

In some embodiments, instead of the lid thread 504, the lid 500 has a lid thread (similar to lid thread 384 of FIG. 3C) complementary to a body thread (e.g., body thread 236 of FIG. 2). In such embodiments, the lid 500 is configured to be screwed into a body surface (e.g., body surface 240 of FIG. 2) using the lid thread and the body thread by twisting the lid 500 when the lid 500 is placed on the mouth of a container. The lid 500 is configured to be scannable by at least one of an x-ray machine or a metal detector for inspecting the container, lid 500, and the beverage. The lid 500 is configured to permit a visual inspection of the beverage through the lid 500. The lid 500 is free of metal and glass.

Figure 6:
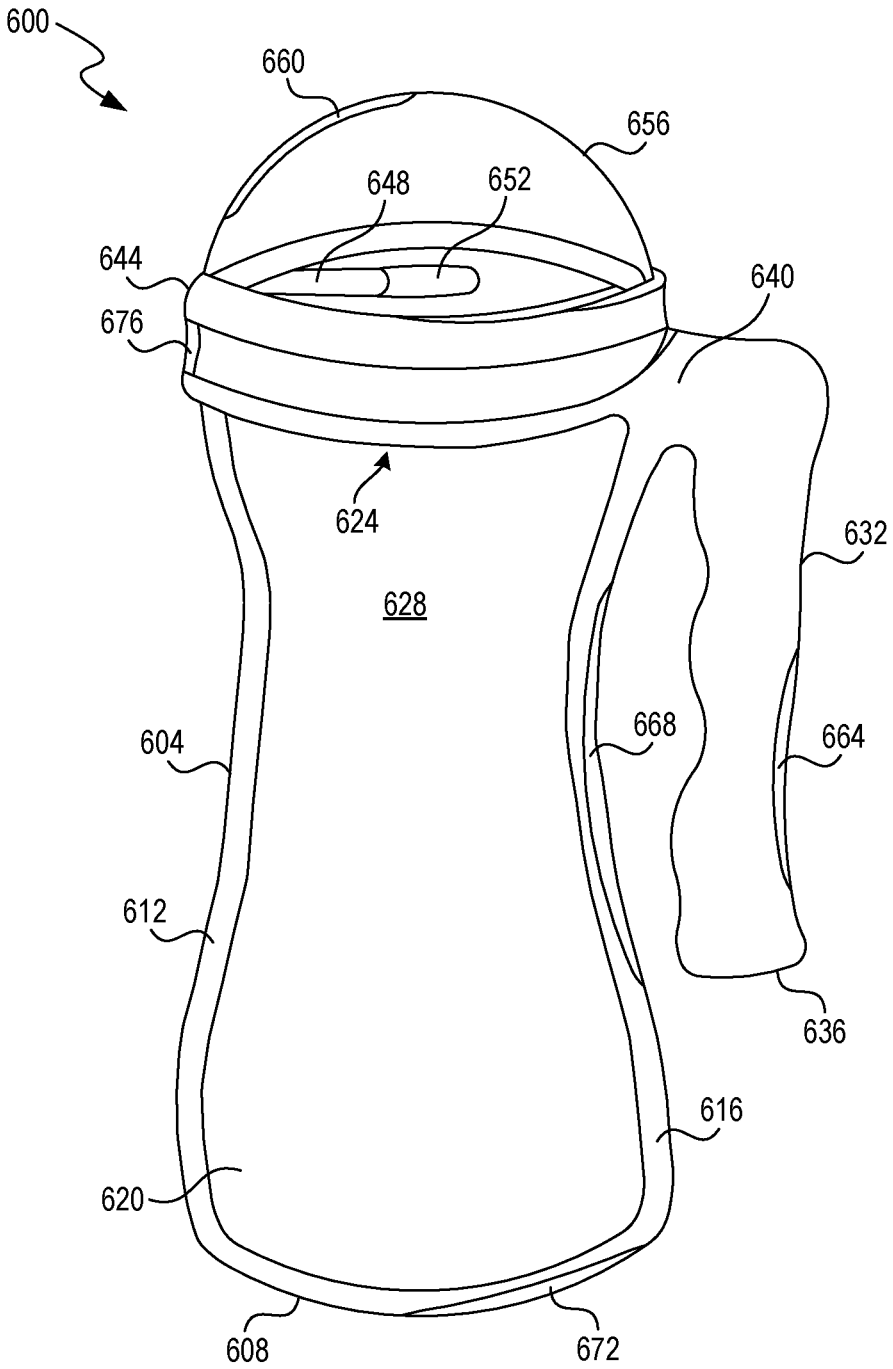
FIG. 6 is a drawing illustrating a transparent scannable beverage container with multiple interchangeable multifunctional lids, in accordance with one or more embodiments.

FIG. 6 is a drawing illustrating a transparent scannable beverage container 600 with multiple interchangeable multifunctional lids, in accordance with one or more embodiments. Likewise, other embodiments include different and/or additional components, or are connected in a different manner. The container 600 includes a cylindrical body 604. The body 604 includes a transparent base 608 and two transparent sidewalls 612, 616 extending from the base 604. The base 608 and transparent sidewalls 612, 616 define a chamber 620 sized to contain a beverage. The sidewalls 612, 616 are configured to thermally insulate the chamber 620. The chamber 620 is open at a mouth 624 of the body 604 distal to the base 608. The container 600 is made of any of the transparent materials described with reference to FIG. 1.

The container 600 includes a transparent handle 632 having two ends 636, 640. The handle 632 is attached to a body surface 628 proximal to the mouth 624 at only one end 640 of the two ends 636, 640. The handle 632 is shaped to be gripped by a user. The container 600 includes a transparent multifunctional lid 644 shaped and sized to be placed on the mouth 624 to seal the chamber 620. The lid 644 is interchangeable with other multifunctional lids, e.g., lids 300, 330, 380 illustrated and described in more detail with reference to FIGS. 3A, 3B, and 3C. The lid 644 includes a transparent latch 648 that can slide into an open configuration or a closed configuration. The latch 648 permits the beverage to exit the lid 644 through an orifice 652 in the lid 644 when the latch 648 is slid into the open configuration for the beverage to be consumed. In some embodiments, the orifice 652 is shaped and sized to permit a drinking straw (e.g., straw 440 of FIG. 4) to be inserted into the chamber 620 through the orifice 652 for the beverage to be consumed through the drinking straw. The latch 648 seals the orifice 652 when the latch 648 is placed in a closed configuration to prevent the beverage exiting the lid 644.

In some embodiments, the container 600 includes a transparent rubber or plastic cover 656 sized to be placed onto the lid 644. The cover 656 is shaped to encase at least the latch 648 and the orifice 652 to prevent transmission of germs proximate to the latch 648 and the orifice 652 when the lid 644 is placed on the mouth 624. The container 600 is configured to be scannable by at least one of an x-ray machine or a metal detector for inspecting the container 600 and the beverage. The container 600 is configured to permit a visual inspection of the beverage through the container 600. The container is free of metal and glass.

In some embodiments, the body surface 628 comprises an antimicrobial layer 668. In some embodiments, the cover 656 comprises an antimicrobial layer 660. In some embodiments, the handle 632 comprises an antimicrobial layer 664.

Figure 7:
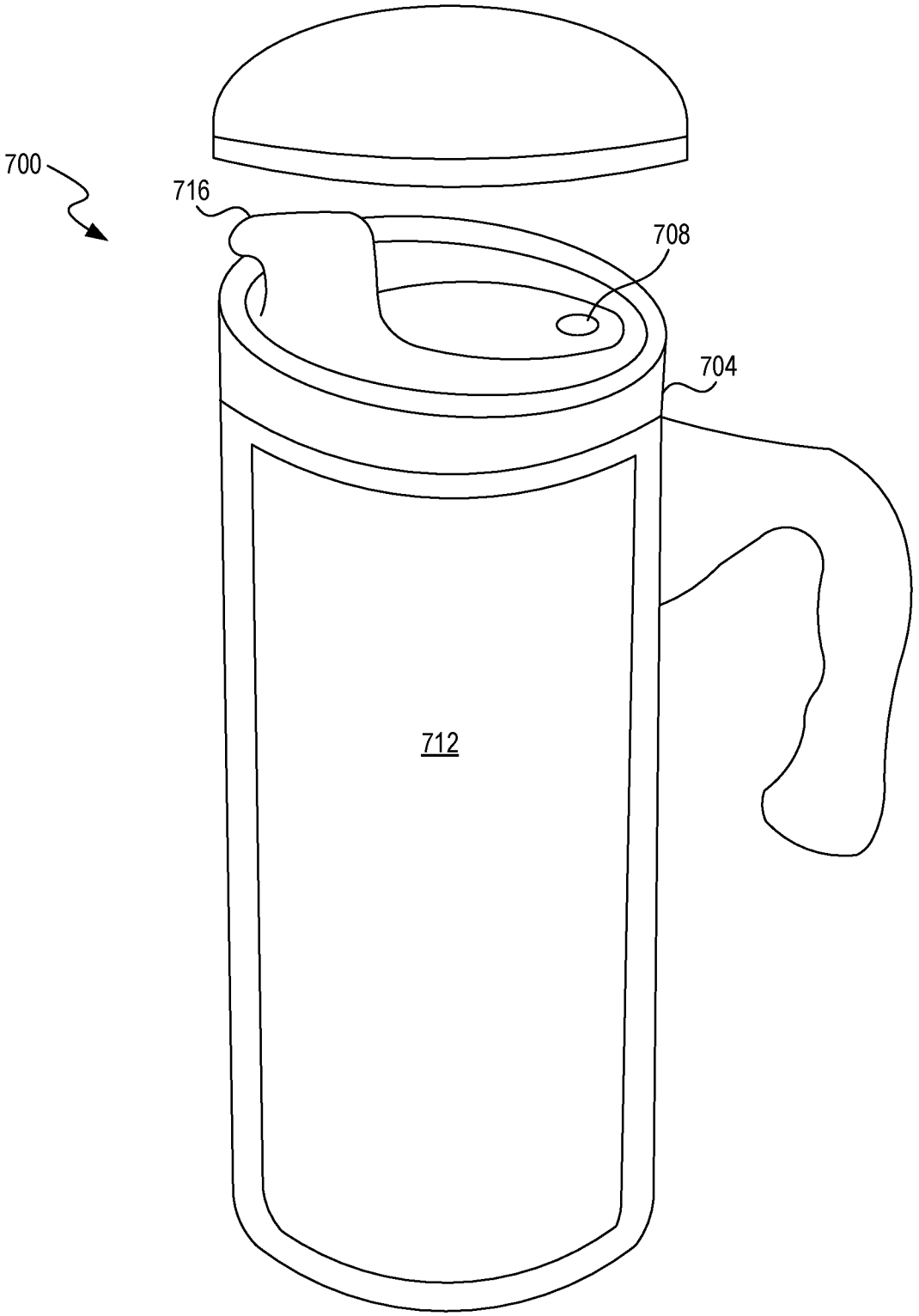
FIG. 7 is a drawing illustrating a transparent scannable beverage container with multiple interchangeable multifunctional lids, in accordance with one or more embodiments.

FIG. 7 is a drawing illustrating a transparent scannable beverage container 700 with multiple interchangeable multifunctional lids, in accordance with one or more embodiments. Likewise, other embodiments include different and/or additional components, or are connected in a different manner. The beverage container 700 includes a cylindrical body 712 defining a chamber sized to contain a beverage. The beverage container 700 includes a transparent lid 704 shaped and sized to be placed on the body 712 to seal the body 712. The lid 704 defines an opening 708 shaped and sized to permit a drinking straw to be inserted into the lid 704 through the opening 708 for the beverage to be consumed through the drinking straw. The lid 704 defines a spout 716 shaped and sized to complement lips of a user for the beverage to be consumed through the spout 716.

In some embodiments, the container 700 includes a transparent rubber or plastic cover sized to be placed onto the lid 704. The cover is shaped to encase the spout 716 and the opening 708 to prevent the transmission of germs proximate to the spout 716 and the opening 708 when the lid 704 is placed on the body 712. The container 700 is configured to be scannable by at least one of an x-ray machine or a metal detector for inspecting the container and the beverage. The container 700 is configured to permit a visual inspection of the beverage through the container 700. The container 700 is free of metal and glass.

Figure 8:
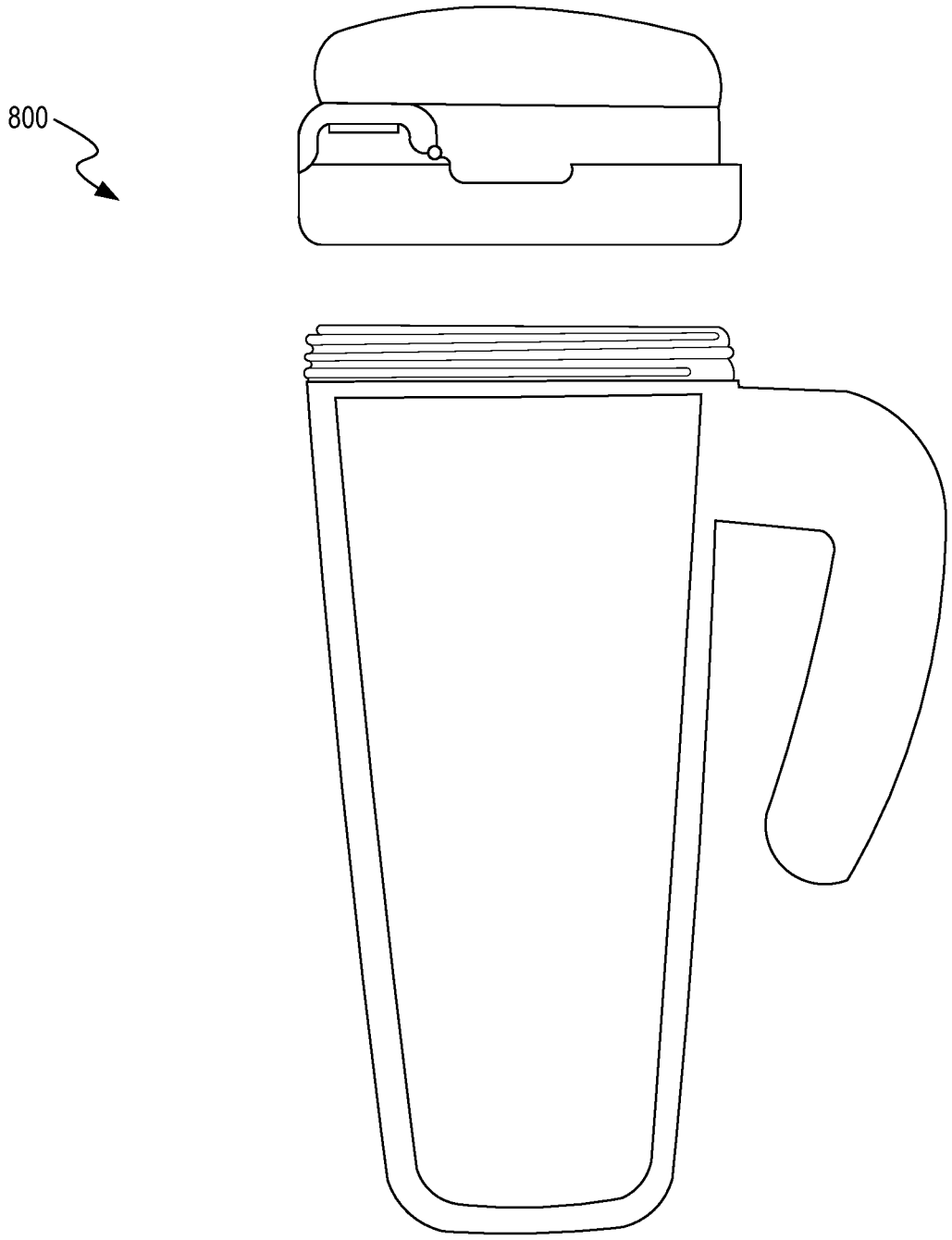
FIG. 8 is a drawing illustrating a transparent scannable beverage container with multiple interchangeable multifunctional lids, in accordance with one or more embodiments.

FIG. 8 is a drawing illustrating a transparent scannable beverage container 800 with multiple interchangeable multifunctional lids, in accordance with one or more embodiments. Likewise, other embodiments include different and/or additional components, or are connected in a different manner. The container 800 includes a transparent body defining a chamber sized to contain a beverage. The chamber is open at a mouth of the body. The body has a body thread on a body surface facing away from the chamber and proximal to the mouth.

A transparent lid is shaped and sized to be placed on the mouth to seal the chamber. The lid includes a transparent slidable latch. The latch is configured to permit the beverage to exit the lid through an orifice in the lid when the latch is open. The orifice is shaped and sized to permit a drinking straw to be inserted into the chamber through the orifice. The latch is configured to seal the orifice when the latch is closed. The lid has a lid thread on a lid surface that is complementary to the body thread. The lid is configured to be screwed into the body surface using the lid thread and the body thread by twisting the lid when the lid is placed on the mouth.

The container is configured to be scannable by at least one of an x-ray machine or a metal detector for inspecting the container and the beverage. The container is configured to permit a visual inspection of the beverage through the container.

Figure 9:
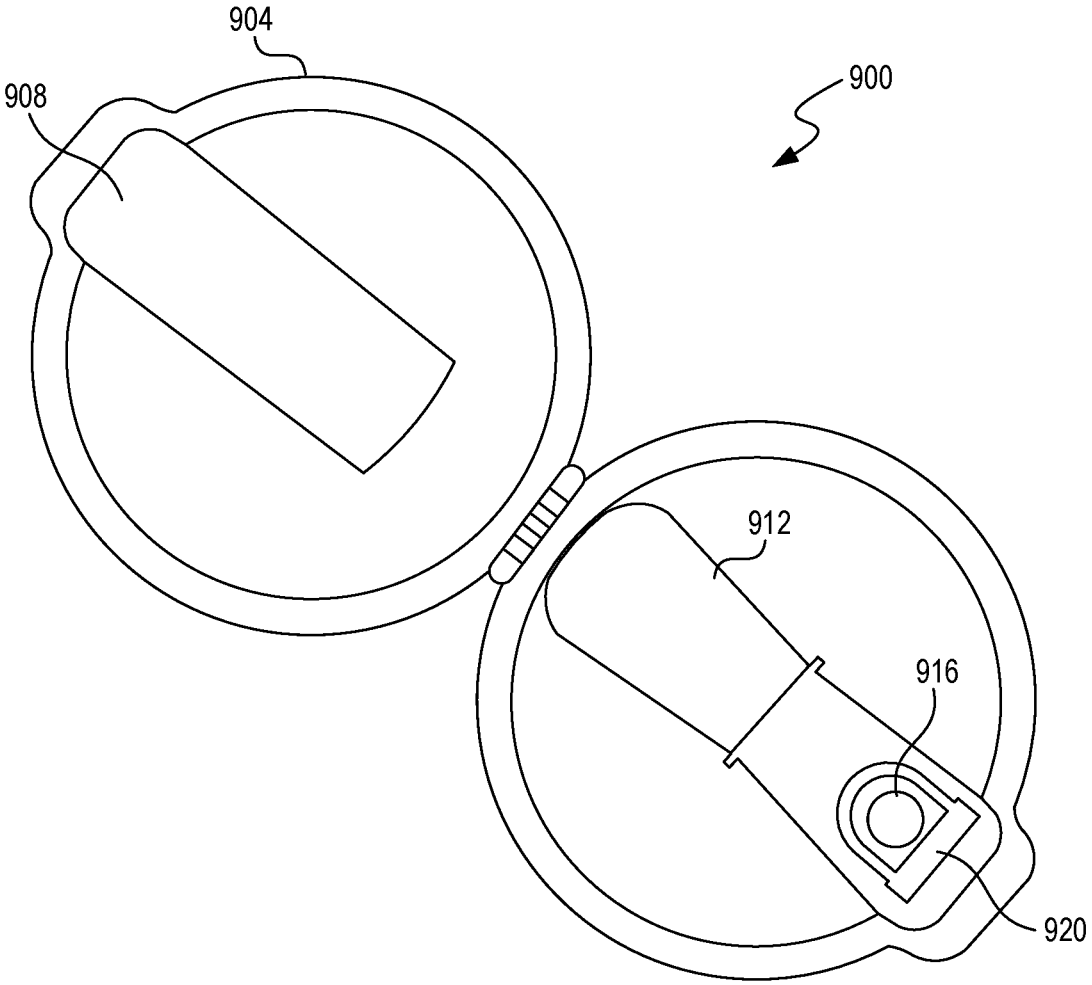
FIG. 9 is a drawing illustrating a transparent scannable multifunctional lid, in accordance with one or more embodiments.

FIG. 9 is a drawing illustrating a transparent scannable multifunctional lid 900, in accordance with one or more embodiments. Likewise, other embodiments include different and/or additional components, or are connected in a different manner. The lid 900 is shaped and sized to be placed on a mouth (e.g., mouth 624 of FIG. 4) of a container (e.g., container 600 of FIG. 6) to seal a chamber (e.g., chamber 620 of FIG. 6) of the container. The lid 900 includes a transparent latch 904. The lid 900 is configured to be screwed onto a beverage container. The latch 904 is configured to permit a beverage to exit the lid 900 through an orifice 916 in the lid 900 when the latch 904 is placed in an open configuration (shown by FIG. 9) for the beverage to be consumed. The orifice 916 is shaped and sized to permit a drinking straw to be inserted into the chamber through the orifice 916 for the beverage to be consumed through the drinking straw. In some embodiments, the orifice 916 is surrounded by a transparent rubber gasket 920.

The latch 904 is configured to seal the orifice 916 when the latch 904 is placed in a closed configuration to prevent the beverage exiting the lid 900. When the latch 904 is placed in the closed configuration, a portion 908 of the latch 904 covers the orifice 916. A portion 912 of the lid 900 engages with the portion 908 to provide a tighter fit when the latch 904 is placed in the closed configuration. The lid 900 is configured to be scannable by at least one of an x-ray machine or a metal detector for inspecting the container and the beverage. The lid 900 is configured to permit a visual inspection of the beverage through the lid 900.

Figure 10A:
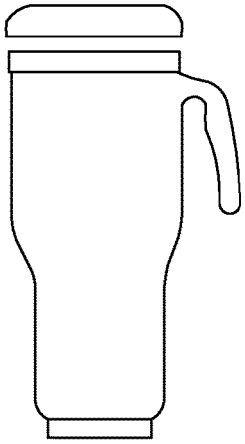
FIGS. 10A, 10B, 10C, 10D, 10E, 10F, and 10G are drawings illustrating transparent scannable beverage containers with multiple interchangeable multifunctional lids, in accordance with one or more embodiments.
Figure 10B:
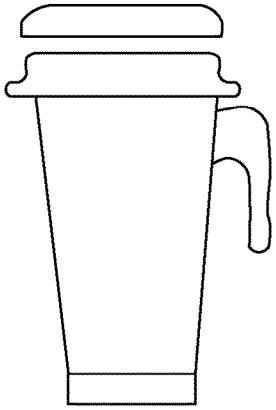
Figure 10C:
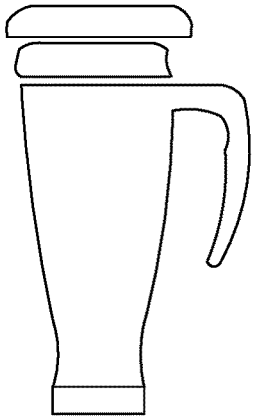
Figure 10D:
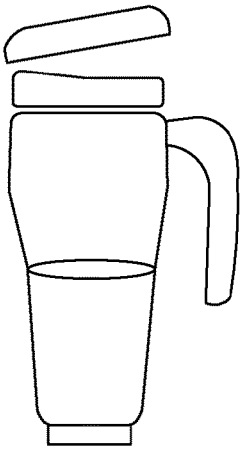
Figure 10E:
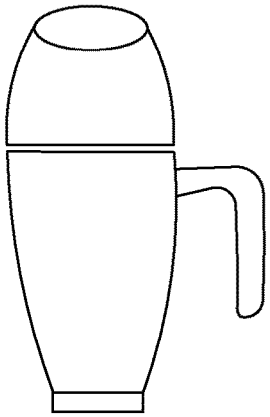
Figure 10F:
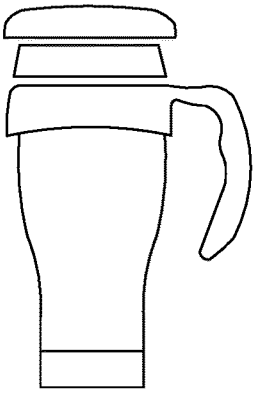
Figure 10G:
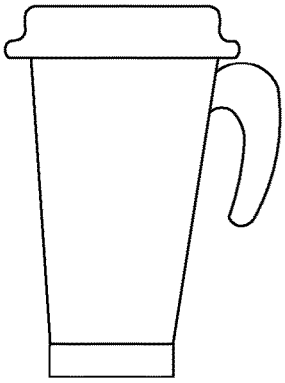

FIGS. 10A, 10B, 10C, 10D, 10E, 10F, and 10G are drawings illustrating transparent scannable beverage containers with multiple interchangeable multifunctional lids, in accordance with one or more embodiments. Likewise, other embodiments include different and/or additional components, or are connected in a different manner. FIG. 10A shows a beverage container having a tapered body. FIG. 10B shows a container having a lid and a transparent cover. FIG. 10C shows a container having a lid and a transparent cover. FIG. 10D shows a container partially filled with a beverage. FIG. 10E shows a container having a dome-shaped cover. FIG. 10F shows a container having a lid and a transparent cover. FIG. 10G shows a container having a lid.

The description and drawings herein are illustrative and are not to be construed as limiting. Numerous specific details are described to provide a thorough understanding of the disclosure. However, in certain instances, well-known details are not described in order to avoid obscuring the description. Further, various modifications may be made without deviating from the scope of the embodiments.

The terms used in this specification generally have their ordinary meanings in the art, within the context of the disclosure, and in the specific context where each term is used. Certain terms that are used to describe the disclosure are discussed above, or elsewhere in the specification, to provide additional guidance to the practitioner regarding the description of the disclosure. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that the same thing can be said in more than one way.

Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any term discussed herein is illustrative only and is not intended to further limit the scope and meaning of the disclosure or of any exemplified term. Likewise, the disclosure is not limited to various embodiments given in this specification.

It is to be understood that the embodiments and variations shown and described herein are merely illustrative of the principles of this invention and that various modifications may be implemented by those skilled in the art.

What is claimed is:

1. A container comprising:

a transparent cylindrical acrylic body defining a chamber sized to contain a beverage, the body sized to fit into a cup-holder of a vehicle, the body comprising:

a transparent base and two concentric transparent sidewalls extending from the transparent base, wherein the chamber is sized to contain 15-20 ounces of the beverage;

a transparent lid shaped and sized to be placed in a mouth of the body to seal the chamber;

a transparent handle having two ends, the transparent handle attached to a body surface proximal to the mouth at only one of the two ends, the transparent handle shaped to be gripped by a user, the transparent handle sized to permit the body to fit into a cup-holder, wherein the transparent handle comprises an open loop handle, wherein the transparent handle is positioned outside of the cup-holder when the body is in the cup-holder; and a transparent rubber skin shaped and sized to fit onto the body and configured to:

restrict the transparent rubber skin from slipping off the body; and reduce heat transfer from the chamber to a hand of the user gripping the transparent rubber skin, wherein the transparent rubber skin comprises an antimicrobial layer.

2. A container comprising:

a transparent cylindrical body defining a chamber sized to contain a beverage, the transparent cylindrical body configured to thermally insulate the beverage, wherein the transparent cylindrical body comprises a transparent base and two concentric transparent sidewalls extending from the transparent base, and wherein the transparent cylindrical body is scannable by either an x-ray machine or a metal detector;

wherein the chamber is open at a mouth of the transparent cylindrical body;

a transparent lid shaped and sized to be placed in the mouth of the transparent cylindrical body to seal the chamber;

a transparent handle having two ends, the transparent handle attached to a body surface proximal to the mouth at only one of the two ends, the transparent handle shaped to be gripped by a user, the transparent handle sized to permit the transparent cylindrical body to fit into a cup-holder, wherein the transparent handle comprises an open loop handle, wherein the transparent handle is positioned outside of the cup-holder when the body is in the cup-holder; and a transparent rubber skin shaped and sized to fit onto the transparent cylindrical body and configured to:

restrict the transparent rubber skin from slipping off the transparent cylindrical body; and reduce heat transfer from the chamber to a hand of the user gripping the transparent rubber skin, wherein the transparent rubber skin comprises an antimicrobial layer.

3. The container of claim 2, wherein the body surface comprises another antimicrobial layer.

4. The container of claim 2, wherein the transparent handle comprises another antimicrobial layer.

5. A container comprising:

a transparent body defining a chamber sized to contain a beverage, wherein the transparent body comprises a transparent base and two concentric transparent sidewalls extending from the transparent base;

a transparent lid shaped and sized to be placed in a mouth of the transparent body to seal the chamber;

a transparent handle having two ends, the transparent handle attached to a body surface proximal to the mouth at only one of the two ends, the transparent handle shaped to be gripped by a user, the transparent handle sized to permit the transparent body to fit into a cup-holder of a vehicle, wherein the transparent handle comprises an open loop handle, wherein the transparent handle is positioned outside of the cup-holder when the body is in the cup-holder; and a transparent rubber skin shaped and sized to fit onto the body and configured to:

restrict the transparent rubber skin from slipping off the transparent body; and reduce heat transfer from the chamber to a hand of the user gripping the transparent rubber skin, wherein the transparent rubber skin comprises an antimicrobial layer.

6. The container of claim 5, wherein the transparent body is a cylindrical acrylic body sized to fit into the cup-holder, and wherein the chamber is sized to contain 15-20 ounces of the beverage.

7. The container of claim 5, wherein the transparent sidewalls are configured to thermally insulate the beverage, wherein the chamber is open at the mouth of the transparent body, and wherein the mouth is distal to the transparent base.

8. The container of claim 5, wherein the transparent body has:

a sidewall thread on a sidewall surface facing the chamber and proximal to the mouth, and a body thread on the body surface facing away from the chamber and proximal to the mouth.

9. The container of claim 8, wherein the transparent lid is an acrylic multifunctional lid, wherein the transparent lid comprises a lid thread on a lid surface, wherein the lid thread is configured to be able to be threaded together with the sidewall thread, and wherein the transparent lid further comprises a transparent latch.

10. The container of claim 9, wherein the transparent lid is configured to be screwed into the sidewall surface using the lid thread and the sidewall thread by moving the transparent latch circularly when the transparent latch is placed in an open configuration.

11. The container of claim 9, wherein the transparent latch is configured to:

permit the beverage to exit the transparent lid through an orifice in the transparent lid when the transparent latch is placed in an open configuration for the beverage to be consumed, the orifice shaped and sized to permit a drinking straw to be inserted into the chamber through the orifice for the beverage to be consumed through the drinking straw.

12. The container of claim 11, wherein the transparent latch is configured to seal the orifice when the transparent latch is placed in a closed configuration to prevent the beverage from exiting the transparent lid.

13. The container of claim 11, comprising a transparent rubber or plastic cover sized to be placed onto the transparent lid, the transparent rubber or plastic cover shaped to encase the transparent latch and the orifice to prevent transmission of germs proximate to the transparent latch and the orifice when the transparent lid is placed in the mouth.

14. The container of claim 5, wherein the container is free of metal.

15. The container of claim 5, wherein the body surface comprises another antimicrobial layer.

16. The container of claim 5, wherein the container is scannable by an x-ray machine or a metal detector for inspecting the container and the beverage, and wherein the container permits a visual inspection of the beverage through the container.

17. The container of claim 5, wherein the transparent body has a body thread on the body surface, the container comprising another transparent lid shaped and sized to be placed on the mouth to seal the chamber, the another transparent lid having a lid thread on a lid surface that is complementary to the body thread.

18. The container of claim 17, wherein the another transparent lid is configured to be screwed into the body surface using the lid thread and the body thread by twisting the another transparent lid when the another transparent lid is placed on the mouth.

19. The container of claim 17, wherein the another transparent lid defines:

an opening shaped and sized to permit a drinking straw to be inserted into the chamber through the opening for the beverage to be consumed through the drinking straw; and a spout shaped and sized for the beverage to be consumed through the spout.

20. The container of claim 19, comprising a transparent rubber or plastic cover sized to be placed onto the another transparent lid, the transparent rubber or plastic cover shaped to encase the spout and the opening to prevent transmission of germs proximate to the spout and the opening when the another transparent lid is placed on the mouth.

* * * * *